US005176324A

United States Patent [19]

Furuse et al.

[11] Patent Number: 5,176,324

[45] Date of Patent: Jan. 5, 1993

[54] FUEL SPRAYING METHOD IN LIQUID FUEL COMBUSTION BURNER, AND LIQUID FUEL COMBUSTION BURNER

[75] Inventors: Yutaka Furuse; Naohito Yoshii; Tuneo Miyake, all of Tokyo, Japan

[73] Assignees: Nippon Oil Co., Ltd.; E.P.S. Engineering Co., Ltd.; Fuji Denki Co., Ltd., all of Tokyo, Japan

[21] Appl. No.: 585,786

[22] Filed: Sep. 20, 1990

[30] Foreign Application Priority Data

Sep. 20, 1989 [JP] Japan ..... 1-241672
Oct. 13, 1989 [JP] Japan ..... 1-265173

[51] Int. Cl.[5] ..... F23D 11/38; F23D 14/58

[52] U.S. Cl. ..... 239/419; 431/8; 431/354; 239/405; 239/600; 239/433

[58] Field of Search ..... 431/2, 8, 175, 181, 431/185, 345, 354; 239/399, 402, 419, 419.3, 419.5, 433, 567, 600, 405

[56] References Cited

U.S. PATENT DOCUMENTS 2,933,259 4/1960 Raskin ..... 239/419 X
3,452,933 7/1969 Hakluytt ..... 431/354 X
3,643,871 2/1972 Hamernik et al. ..... 239/419.3
4,002,297 1/1977 Pillard ..... 239/433 X
4,356,970 11/1982 Vosper et al. ..... 239/8
4,601,428 7/1986 Kurogo ..... 431/354 X

FOREIGN PATENT DOCUMENTS 145116 2/1982 Japan .
0009111 1/1987 Japan ..... 431/2
0787795 12/1980 U.S.S.R. ..... 431/175
2033251 5/1980 United Kingdom .

*Primary Examiner*—Carl D. Price
*Attorney, Agent, or Firm*—Nils H. Ljungman and Associates

[57] ABSTRACT

Disclosed are a fuel spraying method in a liquid fuel combustion burner for spraying a liquid fuel together with an atomization-promoting fluid mixed in the fuel, and a liquid fuel combustion burner, in which the liquid fuel is mixed with the atomization-promoting fluid while turning the liquid fuel in flow passages of injection holes, and streams injected from the injection holes are caused to impinge against one another in the presence of combustion air in a combustion apparatus. According to this fuel spraying method and this liquid fuel combustion burner, the atomization of the liquid fuel is promoted and the flame is dispersed while promoting the contact with air, and it therefore becomes possible to simultaneously control generation of $NO_x$ and generation of soot.

11 Claims, 5 Drawing Sheets

FUEL SPRAYING METHOD IN LIQUID FUEL COMBUSTION BURNER, AND LIQUID FUEL COMBUSTION BURNER

BACKGROUND OF THE INVENTION (1) Field of the Invention

The present invention relates to a fuel spraying method in a liquid fuel combustion burner used for a heating apparatus as a heat source of a boiler, a heating furnace and the like, and a liquid fuel combustion burner. More particularly, the present invention relates to a fuel spraying method in a liquid fuel combustion burner having a structure in which a liquid fuel is sprayed together with a fluid flow of air, steam or a mist of water drops (hereinafter referred to as "atomization-promoting fluid") mixed into the fuel for promoting the atomization of the liquid fuel, and a liquid fuel combustion burner.

(2) Description of the Related Art

A liquid fuel combustion burner having a structure in which a liquid fuel is mixed with an atomization-promoting fluid such as steam or air and the mixed fluid is sprayed from a plurality of injection holes (see Japanese Unexamined Utility Model Publication No. 57-145116) is known.

According to the fuel spraying method adopted for this liquid fuel combustion burner, the liquid fuel to be mixed with the atomization-promoting fluid is atomized and diffused by the expansion energy generated when an atomization-promoting fluid such as steam or air is injected to a low-pressure side from a high-pressure side.

In regards to the above-mentioned spraying method, there are known an internal mixing method in which the injection quantity is controlled while maintaining a certain difference between the pressure of the atomization-promoting fluid and the pressure of the liquid fuel, and an intermediate mixing method in which the pressure of the liquid fuel is changed while maintaining the pressure of the atomization-promoting fluid at a certain level, whereby the injection quantity is controlled.

In these fuel spraying methods, by attaining a slow combustion effect by lowering the flame temperature and reducing the oxygen concentration, control of generation of $NO_x$ is expected while allowing certain generation of soot.

In other words, in the conventional combustion method or fuel spraying method, it is difficult to simultaneously control generation of $NO_x$ and generation of soot.

In the case where fuel injection holes formed in a burner are equidistantly arranged or are distributed in a divided state resembling the equidistant arrangement as disclosed in Japanese Unexamined Utility Model Publication No. 57-145116, generation of soot can be controlled but since the heat dissipation is degraded, control of generation of $NO_x$ is difficult, and it is therefore impossible to simultaneously control generation of $NO_x$ and generation of soot.

OBJECT OF THE INVENTION

It is a primary object of the present invention to simultaneously control generation of $NO_x$ and generation of soot in a liquid fuel combustion burner.

SUMMARY OF THE INVENTION

Under this background, the present invention has been completed to solve the foregoing problem of the conventional technique of not being able to simultaneously control the $NO_x$ and soot generation in a burner having a structure in which a liquid fuel is sprayed together with an atomization-promoting fluid which is mixed into the liquid fuel and also in a fuel spraying method in this liquid fuel combustion burner.

In accordance with the present invention, the foregoing object can be attained by a fuel spraying method in a liquid fuel combustion burner, which fuel spraying method comprises turning a liquid fuel in a flow passage having a sectional area restricted for constringing a flow of the liquid fuel, simultaneously introducing an atomization-promoting fluid into said flow passage to mix the atomization-promoting fluid into the liquid fuel, injecting a plurality of streams of the mixture of the liquid fuel and atomization-promoting fluid from said flow passage, and causing the injected mixture streams to impinge against one another in the presence of combustion air.

According to this method, the liquid fuel and the atomization-promoting fluid such as steam are injected into the flow passage where they are mixed. Namely, the intermediate mixing method is adopted.

Accordingly, as compared with the internal mixing method in which the liquid fuel is mixed with the atomization-promoting fluid and the formed mixture is injected from the flow passage, this spraying method is advantageous in that the consumption of steam can be reduced and the atomizing effect can be improved.

Moreover, by turning the liquid fuel in the flow passage, the atomizing effect can be further improved.

Still further, since a plurality of streams injected into the heating apparatus from the flow passage are caused to impinge against one another in the presence of combustion air, a mutual shearing force is generated to promote the atomization and also promote the contact with oxygen in the interior of the boiler or the like where the burner is arranged, whereby the flame can be dispersed.

It is preferred that the mixed streams of the liquid fuel and the atomization-promoting fluid be injected so that the crossing angle is in the range of 10° to 120°, preferably 20° to 90°.

If the crossing angle is thus adjusted, the stability of the combustion flame can be further increased.

Furthermore, in accordance with the present invention, there is provided a liquid fuel combustion burner attached to the top end portion of a tube projected into the interior of a combustion apparatus proper and having a structure in which a liquid fuel supplied through a fuel passage formed in the interior of the tube is sprayed into the interior of the combustion apparatus proper together with an atomization-promoting fluid which is supplied through an atomization-promoting fluid passage formed in the interior of the tube, the burner comprising a burner proper having, formed therein, a liquid fuel supply passage, an atomization-promoting fluid supply passage, a plurality of injection holes, a connecting passage connecting the downstream end of the atomization-promoting fluid passage to the injection holes and a connecting passage connecting the downstream end of the liquid fuel supply passage to the side portions of the injection holes, wherein the injection holes are arranged in the state divided into a plurality of groups, each group including a plurality of injection holes, and the respective injection holes are opened in such directions that in each group of the injection holes, the central axes of the injection holes extend to cross one another at a predetermined angle.

In the liquid fuel combustion burner having the above-mentioned structure, a liquid fuel supplied in the burner proper is introduced in the fuel supply passage, is guided to the connecting passage from the fuel supply passage and is injected into the injection holes from the side faces of the injection holes. The atomization-promoting fluid is introduced into the atomization-promoting fluid supply passage and injected into the interiors of the injection holes from this passage through the connecting passage.

The liquid fuel flows in the injection hole in the form of a turning stream, is mixed with steam flowing into the injection hole and is sprayed from the top end of the injection hole.

Streams injected from a plurality of injection holes in each group are caused to impinge against one another in the presence of combustion air in the combustion apparatus.

The above-mentioned predetermined angle is in the range of from 10° to 120°, preferably from 20° to 90°.

It is preferred that the respective injection holes be arranged to extend in such directions that in each group of the injection holes, the central axis of the burner proper forms a predetermined angle with the impinging point of the streams from the injection hoes, and it is especially preferred that this predetermined angle be 20° to 20°.

In this embodiment, the injection hoes are arranged in the vicinity of the peripheral portion of the burner proper and small flames can be formed in the dispersed state, and therefore, a good heat dissipation is attained and the flame temperature can be lowered. Accordingly, the residence time of gas in a high-temperature zone can be shortened.

A circular recess can be formed as the atomization-promoting fluid supply passage at a central part of the rear end face of the burner proper.

In this embodiment, the productivity of the burner proper can be increased, and mass production and reduction of the cost become possible.

An annular groove can be formed as the liquid fuel supply passage at a peripheral part of the rear end face of the burner proper.

In this embodiment, the productivity of the burner proper can be increased, and the mass production and reduction of the cost become possible.

The connecting passage connecting the downstream end to the side portions of the respective injection holes can be connected substantially in a tangential direction of each injection hole.

In this embodiment, the productivity of the burner proper can be increased, and mass production and reduction of the cost become possible.

The burner proper can comprise a fuel supply member and a burner tip connected to the top end portion of the fuel supply member.

In this embodiment, the productivity of the burner proper can be increased, and mass production and reduction of the cost become possible.

One feature of the invention resides broadly in a fuel spraying method in a liquid fuel combustion burner, which comprises turning a liquid fuel in a flow passage having a sectional area restricted for constringing a flow of the liquid fuel, simultaneously introducing an atomization-promoting fluid into said flow passage to mix the atomization-promoting fluid into the liquid fuel, injecting a plurality of streams of the mixture of the liquid fuel and atomization-promoting fluid from said flow passage, and causing the injected mixture streams to impinge against one another in the presence of combustion air.

Another feature of the invention resides broadly in a liquid fuel combustion burner attached to the top end portion of a tube projected into the interior of a combustion apparatus proper and having a structure in which a liquid fuel supplied through a fuel passage formed in the interior of the tube is sprayed into the interior of the combustion apparatus proper together with an atomization-promoting fluid supplied through an atomization-promoting fluid passage formed in the interior of the tube and mixed with the fuel, said burner comprising a burner proper having, formed therein, a liquid fuel supply passage, an atomization-promoting fluid supply passage, a plurality of injection holes, a connecting passage connecting the downstream end of the atomization-promoting fluid passage to the injection holes and a connecting passage connecting the downstream end of the liquid fuel supply passage to the side portions of the injection holes, wherein the injection holes are arranged in the state divided into a plurality of groups, each group including a plurality of injection holes, and the respective injection holes are opened in such directions that in each group of the injection holes, the central axes of the injection holes extend to cross one another at a predetermined angle.

One aspect of the invention resides broadly in a method of spraying fluid fuel from a fluid fuel combustion nozzle, the method comprising the steps of: introducing the fluid fuel into at least two flow passages of the fluid fuel combustion nozzle, swirling the fluid fuel in at least one of the at least two flow passages, introducing a division-promoting fluid into at least one of the at least two flow passages to divide the fluid fuel and form a mixed fluid of the division-promoting fluid and the fluid fuel, spraying the fluid out of each of the at least two flow passages to form at least two fluid streams, and impinging the stream of fluid from one of the at least two streams with the stream of fluid from another of the at least two streams.

Another aspect of the invention resides broadly in a fluid fuel spray nozzle for use in a boiler, a heating furnace or the like, the fluid fuel spray nozzle comprising: at least one fluid fuel supply passage, at least one division-promoting fluid supply passage for providing a division-promoting fluid for dividing the fluid fuel, at least one injection passage aligned with the at least one division-promoting fluid supply passage, at least one connecting passage connecting the at least one injection passage to the at least one fuel supply passage, the at least one connecting passage substantially tangentially connected to the at least one injection passage, the at least one connecting passage or the at least one injection passage being configured for producing swirling of the fluid fuel upon the field fuel being introduced into the at least one injection passage through the at least one connecting passage from the at least one fuel supply passage, the division-promoting fluid and the swirling fluid fuel being mixed in the injection passage to form a mixed fluid, apparatus for providing at least two streams of the mixed fluid so that one of the two steams of mixed fluid impinges the other of the at least two streams of mixed fluid at a predetermined angle upon the streams of mixed fluid being sprayed out of the nozzle.

The present invention will now be described in detail with reference to embodiments illustrated in the accompanying drawings, from which the present invention will be readily understood. However, these embodiments do not limit the scope of the present invention, and various modifications can be made within the range defined by the claims.

DETAILED DESCRIPTION OF THE PREFERRED EMBODIMENTS

Figure 1:
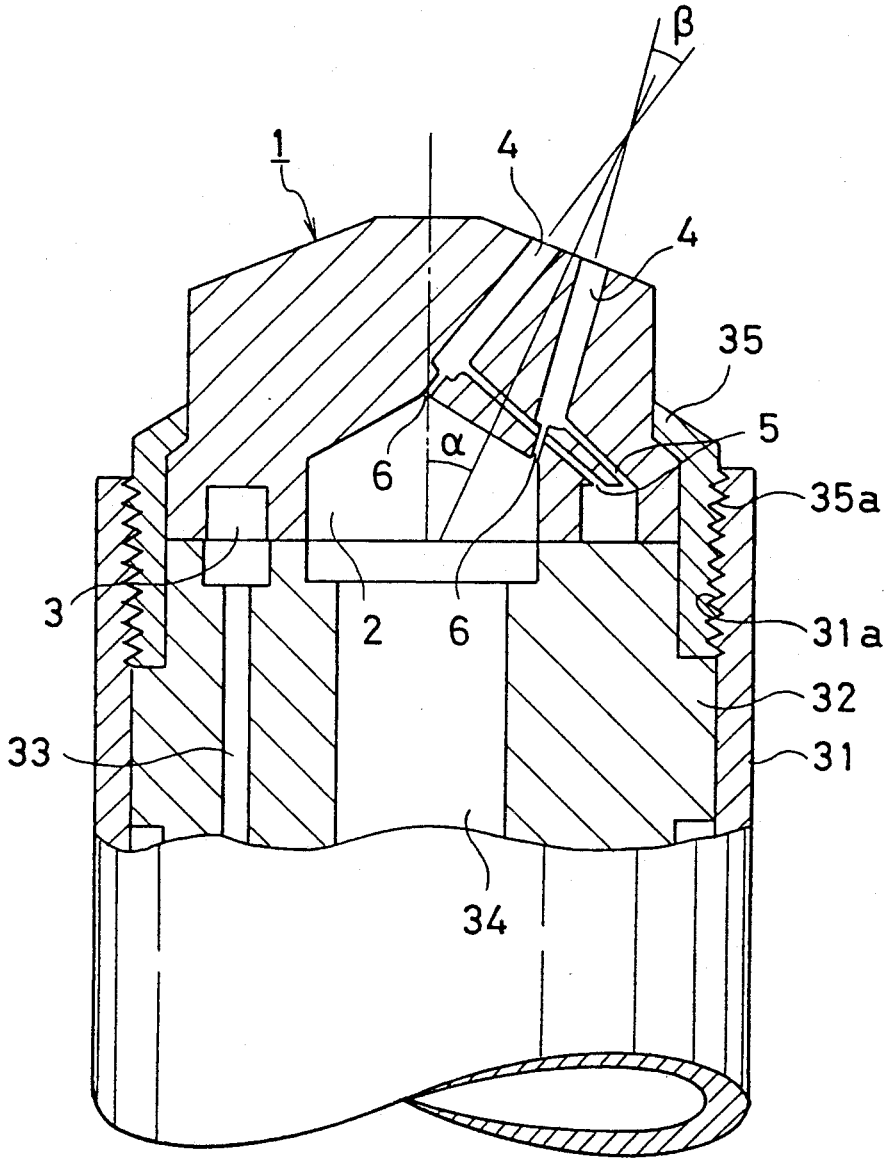
FIG. 1 is a sectional view illustrating one embodiment of the liquid fuel combustion burner according to the present invention.
Figure 2:
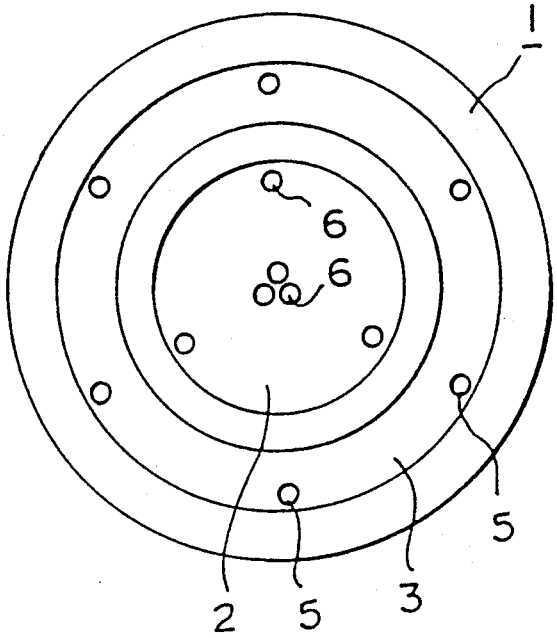
FIG. 2 is a bottom view of the burner shown in FIG. 1
Figure 3:
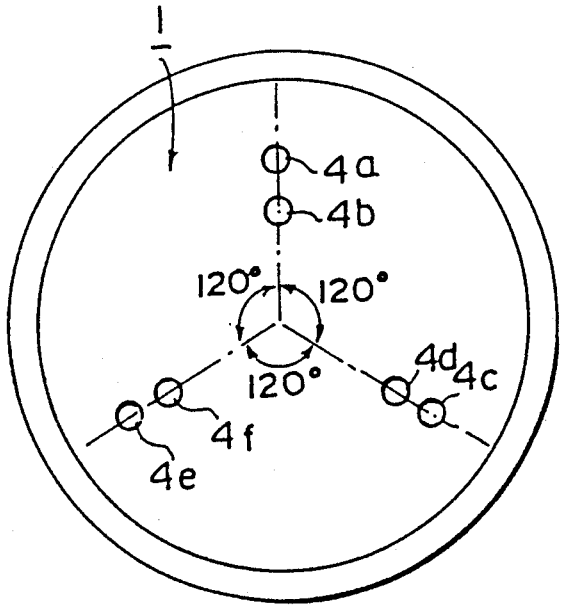
FIG. 3 is a top face view of the burner shown in FIG. 1.

Referring to FIGS. 1 through 3, a liquid fuel combustion burner is inserted through the peripheral wall of a furnace proper as a combustion apparatus proper, not shown in the drawings, and is used in the state where the top end side of the burner is fixed to the top end portion of a guide pipe 31 projected into the interior of the furnace proper. An adapter 32 is inserted and fixed in the guide pipe 31, and in the adapter 32, there are formed passages 33 and 34 respectively connected to a fuel supply pipe and an atomization-promoting fluid supply pipe, which are extended from a fuel supply source and an atomization-promoting fluid supply source, not shown in the drawings. A cylindrical cap 35 is engaged with a burner proper 1 in the state where the top end face of the burner proper 1 is projected, through the cap 25 by fitting a male screw 35*a* formed on the peripheral face of the cap 35 to a female screw 31*a* formed on the inner circumferential face of the guide pipe 31, the burner proper 1 is fixed to the top end portion of the guide pipe 31. In this attachment state of the burner proper 1, the passages 33 and 34, communicating with the fuel supply pipe, and the atomization-promoting fluid supply pipe are connected to an annular groove 3 and a circular recess 2, described hereinafter, of the burner proper 1.

The circular recess 2 is formed as the atomization-promoting fluid supply passage at a central part of the rear end face of the burner proper 1. The top end portion of this circular recess 2 is formed to have a shape of a circular cone.

The annular groove 3 is formed at the liquid fuel supply passage at a peripheral part of the rear end face of the burner proper 1.

Furthermore, an injection hole 4 having one end opened to the inner face of the circular recess 2 through a small-diameter hole 6 and the other end opened to the outer face of the top end portion of the burner proper 1 is formed to pierce between the circular recess 2 and annular groove 3 of the burner proper 1.

The annular groove 3 and the injection hole 4 are connected to each other through a connecting hole 5 extending from the annular groove 3 substantially in the tangential direction of the injection hole.

In this embodiment, six injection holes 4*a* through 4*f* are arranged and these injection holes 4*a* through 4*f* are divided into three groups, that is, a group of injection holes 4*a* and 4*b*, a group of injection holes 4*c* and 4*d* and a group of injection holes 4*e* and 4*f*. These groups are arranged at three positions spaced by 120° from one another with the central axis of the burner proper 1 being as the center. In each group, the injection holes 4*a* and 4*b*, 4*c* and 4*d* or 4*e* and 4*f* are arranged to extend in such directions that the central axes of the injection holes cross each other at a predetermined angle $\beta$ and the central axis of the burner proper 1 forms a predetermined angle $\alpha$ with the impinging point of the streams injected from the injection holes. The predetermined angle $\beta$ is 10° to 120°, preferably 20° to 90°, and the predetermined angle $\alpha$ is 20° to 40°.

The combustion and spraying method in the liquid fuel combustion burner having the above-mentioned structure will now be described.

The liquid fuel supplied to the burner proper 1 is introduced into the annular groove 3, guided to the connecting hole 5 from the annular groove 3 and injected from the side face of the injection hole 4 into the interior thereof. Steam, as the atomization-promoting fluid, is introduced into the circular recess 2, guided into the small-diameter hole 6 from the circular recess 2 and injected into the interior of the injection hole 4 from the rear end face of the injection hole 4.

At this point, the liquid fuel flows as a turning stream in the injection hole 4 and is mixed with steam which advances straight from the small-diameter hole 6 and flows into the injection hole 4, and the mixture is jetted from the top end of the injection hole 4.

In each group of the injection holes, streams injected from two injection holes are caused to impinge against each other in the presence of combustion air in the combustion apparatus.

According to this fuel spraying method, the liquid fuel and the atomization-promoting fluid are injected into the injection hole and they are mixed in the injection hole. That is, the intermediate mixing method is adopted.

According to this intermediate mixing method, the injection quantity is controlled by changing the pressure of the liquid fuel while maintaining the pressure of the atomization-promoting fluid at a certain level. Therefore, the consumption of the atomization-promoting fluid is advantageously reduced.

Incidentally, the internal mixing method in which the injection quantity is controlled while maintaining a certain difference between the pressure of the atomization-promoting fluid and the pressure of the liquid fuel, is defective in that the consumption of the atomization-promoting fluid is large.

By turning the liquid fuel in the injection hole 4, the atomizing effect is further enhanced.

Since the streams injected from two injection holes are caused to impinge against each other in the presence of combustion air in the combustion apparatus, the atomizing effect is enhanced by a mutual shearing force generated at the impingement, and simultaneously, the contact with oxygen in a boiler or the like where the burner is arranged is promoted and the flame can be dispersed.

A larger impinging angle of the injected streams is more effective for the atomization, but if the impinging angle is adjusted to 10° to 120°, preferably 20° to 90°, the stability of the combustion flame can be increased.

The atomizing effect can be further enhanced if the speed of the stream injected from the injection stream g is adjusted to an ultrasonic speed.

Furthermore, since the injection holes are arranged so that the central axis of the burner proper 1 forms a predetermined angle with the impinging point of the streams injected from two injection holes of each group, dispersed small flames can be formed and a good heat dissipation can be attained, and therefore, the flame temperature can be lowered and the residence time of gas in a high-temperature zone can be shortened.

By the above-mentioned atomization of the liquid fuel and the above-mentioned dispersion of the flame, the thickness of the flame layer can be reduced and the combustion speed can be increased, and generation of soot can be controlled while controlling generation of $NO_x$.

The effects of the fuel spraying method of the present invention illustrated hereinbefore with reference to FIGS. 1 through 3 will become apparent from experimental results shown in Table 1.

TABLE 1

Figure 10:
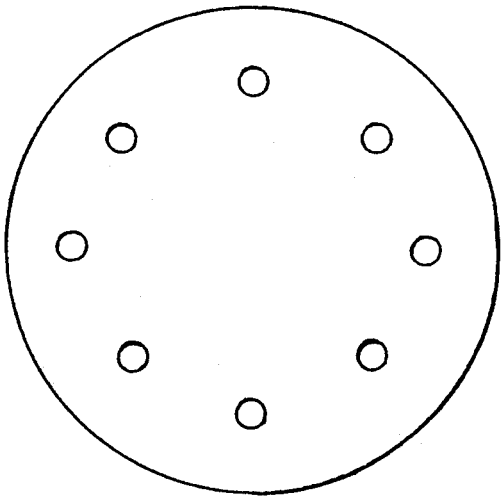
FIG. 10 is a plan view showing an example of the arrangement of injection holes in the conventional burner.

| | Conventional Burner | Burner of Present Invention |
|---|---|---|
| capacity of boiler | 1.5 t/h | 1.5 t/h |
| spraying method | internal mixing | intermediate mixing |
| arrangement of injection holes | equidistantly arranged | divided in three groups |
| size of injection holes | Ø2.6 × 8 holes FIG. 10 | Ø2.6 × 6 holes FIGS. 1 through 3 |
| fuel oil | kerosene | kerosene |
| combustion oil rate | 140 l/h | 140 l/h |
| steam feed rate | 50 kg/h | 50 kg/h |
| sprayed oil pressure | 2.8 kg/cm$^2$ | 2.8 kg/cm$^2$ |
| sprayed steam pressure | 5.5 kg/cm$^2$ | 4.4 kg/cm$^2$ |
| opening degree of register | 50% | 50% |
| $O_2$ level (%) in exhaust gas | 1 2 4 | 1 2 4 |
| $NO_x$ concentration (ppm) calculated as $O_2$ = 4% | 44 47 53 | 30 36 38 |
| smoke density | 5.5 2 0 | 0.5 0 0 |

In this Table 1, and Table 2 given hereinafter, the conventional burner is one having the injection hole arrangement shown in FIG. 10.

Figure 4:
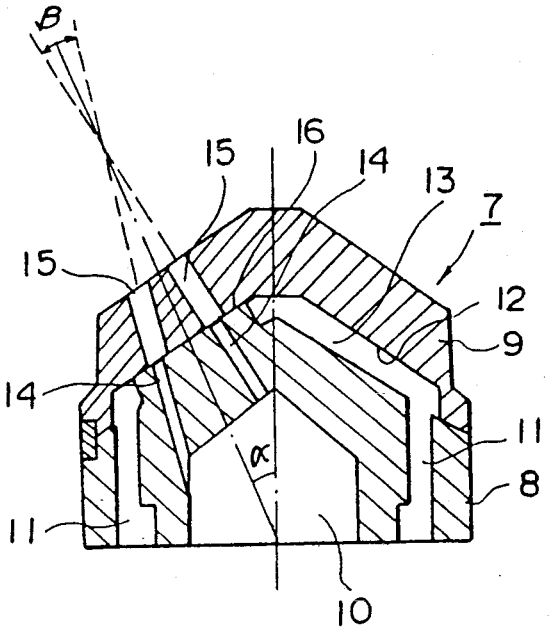
FIG. 4 is a sectional view illustrating another embodiment of the liquid fuel combustion burner according to the present invention.
Figure 5:
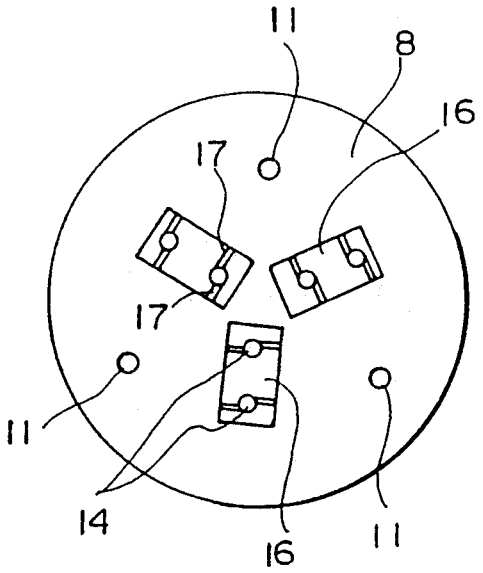
FIG. 5 is a top face view illustrating a fuel supply member constituting the burner proper shown in FIG. 4.
Figure 6:
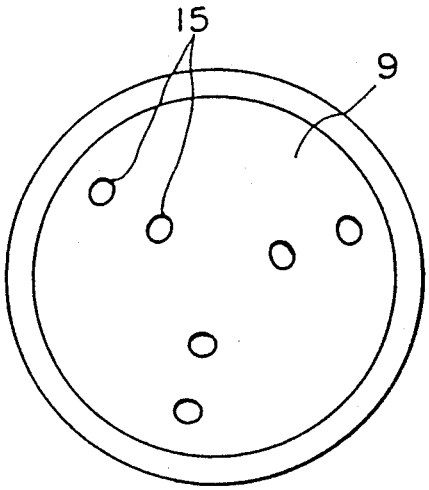
FIG. 6 is a top face view illustrating a burner tip constituting the burner proper shown in FIG. 4.

Referring to FIGS. 4 through 6 illustrating the structure of another embodiment of the liquid fuel combustion burner of the present invention, a burner proper 7 comprises a fuel supply member 8 and a burner tip 9 connected to the fuel supply member 8.

A circular recess 10 having a top end portion having a shape of a circular cone is formed as the atomization-promoting fluid supply passage at a central part of the fuel supply member 8. Three liquid fuel supply holes 11 are vertically formed as the liquid fuel supply passage around the circular recess 10 in the fuel supply member 8. A part of the top end face of the fuel supply member 8 is shaved off, and a vacant space 13 acting as the fuel supply passage is formed between this top end face and the bottom face of the burner tip 9.

The burner tip 9 has a hole 15 having one end opened to the inner face of the circular recess 10 through a small-diameter hole 14 formed in the fuel supply member 8 and the other end opened to the outer face of the top end. The injection hole is constructed by the small-diameter hole 14 and the hole 15. The opening of the small-diameter hole 14 communicating with the hole 15 is formed on a convex portion 16 formed on the top end face of the fuel supply member 8.

The vacant space 13 is connected to each small-diameter hole 14 through a pair of connecting grooves 17 formed on the convex portion 16 to extend from both the side faces of the convex portion 16 to both the sides of the small-diameter hole 14 substantially in the tangential direction.

In the present embodiment, six injection holes are arranged and they are divided into three groups, which are located separately from one another by 120° in the circumferential direction with the central axis of the burner proper 7 being as the center. In each group, two injection holes are arranged in parallel in the radial direction of the burner proper 7, and these injection holes are extended in such directions that the central axes of the injection holes cross each other at a predetermined angle $\beta$ and the central axis of the burner proper 7 forms a predetermined angle $\alpha$ with the impinging point of the streams injected from the injection holes.

The predetermined angle $\beta$ is 10° to 120°, preferably 20° to 90°, as in the embodiment shown in FIGS. 1 through 3, and the predetermined angle is 20° to 40° as in the embodiment shown in FIGS. 1 through 3.

In the liquid fuel combustion burner having the abovementioned structure, the liquid fuel supplied in the burner proper 7 is introduced into the liquid supply hole 11 and arrives at the vacant space 13 from the liquid fuel supply hole 11. Then, the liquid fuel is injected from both the sides of the small-diameter hole 14 through a pair of the connecting grooves 17 and arrives at the hole 15.

Steam, as the atomization-promoting fluid, is introduced into the circular recess 10, guided into the small-diameter hole 14 from the circular recess 10 and is injected into the hole 15 from the rear end face of the hole 15.

At this point, the liquid fuel flows as a turning stream through the small-diameter hole 14 and hole 15, advances straight from the small-diameter hole 14 and is mixed with steam flowing into the hole 15, and the mixture is injected from the top end of the hole 15.

Figure 9:
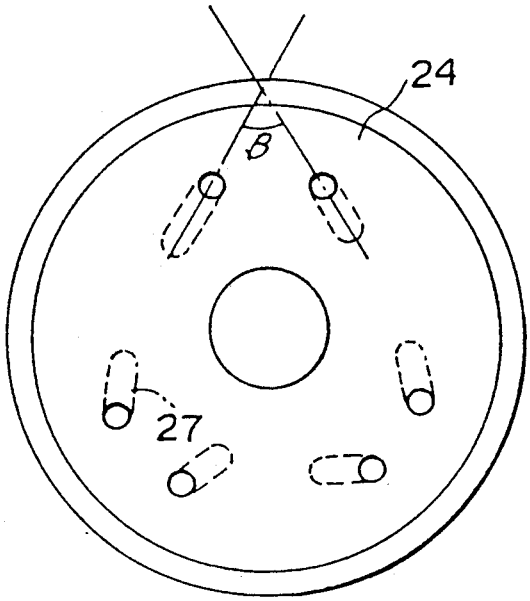
FIG. 9 is a top face view of the burner tip shown in FIG. 8.
Figure 7:
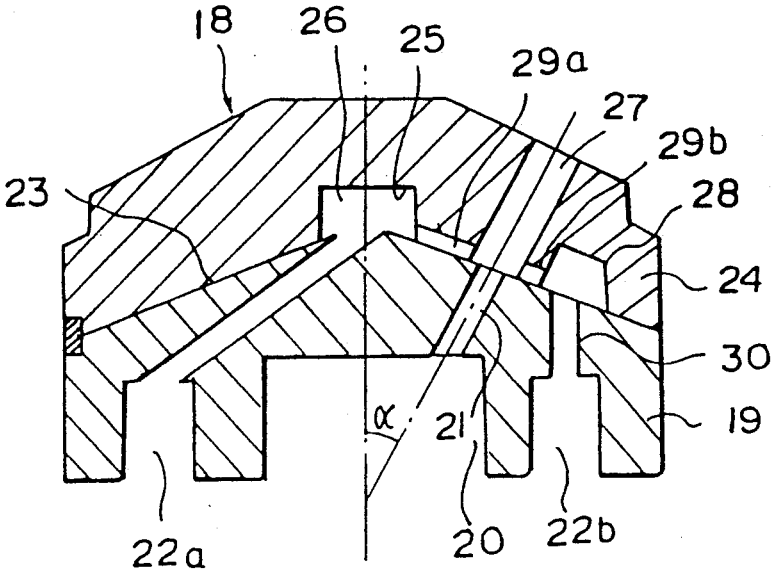
FIG. 7 is a sectional view illustrating still another embodiment of the liquid fuel combustion burner according to the present invention.
Figure 8:
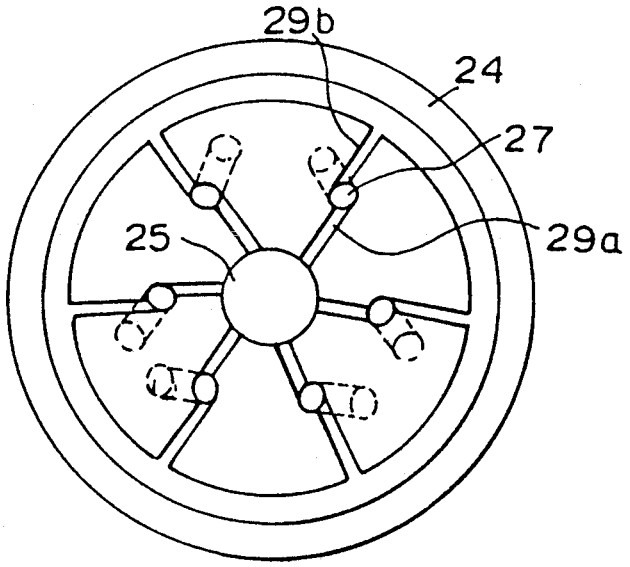
FIG. 8 is a bottom view of a burner tip constituting the burner proper shown in FIG. 7.

Referring to FIGS. 7 through 9 illustrating the structure of still another embodiment of the liquid fuel combustion burner of the present invention, a circular recess 20 is formed as the atomization-promoting fluid supply passage at a central part of the rear end face of a fuel supply member 19. The fuel supply member 19 has, formed therein, a small-diameter hole 21 having one end connected to the circular recess 20 and the other end opened to the inclined top end face of the fuel supply member 19, liquid fuel supply holes **22*a* and 22*b* as the liquid fuel supply passage located around the circular recess 20, a communicating hole 23 having one end communicating with one liquid fuel supply hole 22***a* and the other end opened to the top of the fuel supply member 19, and a communicating hole 30 having one end communicating with the other liquid fuel supply hole 22*b* and the other end opened to an annular groove 28 formed on the rear end face of a burner tip 24. A circular recess 25 communicating with the communicating hole 23 opened to the top of the fuel supply member 19 is formed at a central part of the rear face of the burner tip 24, and a vacant space 26 acting as the fuel supply passage is formed between the circular recess 25 and the top end face of the fuel supply member 8.

A hole 27 having one end opened to the inner face of the circular recess 20° through the small-diameter hole 21, and the other end having a hole 27 opened to the outer face of the top thereof, is formed to pierce through the burner tip 24.

The injection hole is constructed by the small-diameter hole 21 and the hole 27.

Furthermore, between the rear end face of the burner tip 24 and the top end face of the fuel supply member 19, a communicating groove 29*a* connecting the vacant space 26 to the hole 27, and a communicating groove 29*b*, connecting the annular groove 28 to the hole 27, are formed.

These communicating grooves 29*a* and 29*b* extend substantially in the tangential direction of the hole 27 and communicate with the hole 27.

Also in this embodiment, six injection holes are formed and they are divided into three groups. The three groups of the injection holes are located separately from one another by 120° in the circumferential direction, with the central axis of the burner proper 18 being as the center. In each group, the two injection holes are formed to extend in such directions that the central axes of the injection holes cross each other at a predetermined angle $\beta$ and the center axis of the burner proper 18 forms a predetermined angle $\alpha$ with the impinging point of the streams injected from the injection holes.

The predetermined angle $\beta$ is 10° to 120°, preferably 20° to 90°, as in the embodiment shown in FIGS. 1 through 3 and the embodiment shown in FIGS. 4 through 6.

Furthermore, the predetermined angle g is 20° to 40°, as in the foregoing embodiments.

In the liquid fuel combustion burner having the above-mentioned structure, a part of the liquid fuel supplied in the burner proper 18 is introduced into the liquid fuel supply hole 22*a*, arrives at the vacant space 26 through the communicating hole 23, and is then guided to the hole 27 through the communicating groove 29*a*. The remainder of the liquid fuel is introduced into the liquid fuel supply hole 22*b*, arrives at the annular groove 28 through the communicating hole 30° and is guided to hole 27 through the communicating groove 29*b*.

Steam, as the atomization-promoting fluid, is introduced into the circular recess 20, guided into the small-diameter hole 21 from the circular recess, and injected into the injection hole 27 from the rear end face thereof through the small-diameter hole 21.

At this point, the liquid fuel flows as a turning stream in the hole 27 and is mixed with the steam which advances straight from the small-diameter hole 21 and flows into the hole 27, and the mixture is injected from the top end of the hole 27.

The effects of the fuel spraying method of the present invention described above with reference to FIGS. 7 through 9 will become apparent from experimental results shown in Table 2.

TABLE 2

| | Conventional Burner | Burner of Present Invention |
|---|---|---|
| capacity of boiler | 3 t/h | 3 t/h |
| spraying method | internal mixing | intermediate mixing |
| arrangement of injection holes | equidistantly arranged | divided in three groups |
| size of injection holes | Ø2.6 × 8 holes FIG. 10 | Ø2.6 × 6 holes FIGS. 7 through 9 |
| fuel oil | kerosene | kerosene |
| combustion oil rate | 270 l/h | 270 l/h |
| sprayed oil pressure | 3.5 kg/cm$^2$ | 4.7 kg/cm$^2$ |
| sprayed steam pressure | 4.5 kg/cm$^2$ | 4.5 kg/cm$^2$ |
| opening degree of register | 50% | 60% |
| $O_2$ level (%) in exhaust gas | 1.5 4 | 1.5 4 |
| $NO_x$ concentration (ppm) calculated as $O_2$ = 4% | 93 100 | 40 40 |
| smoke density | 5.5 0 | 0.5 0 |

In the foregoing embodiments, a plurality of injection holes are divided into a plurality of groups, each consisting of two injection holes, but in the present embodiment, the injection holes can be divided into a plurality of groups, each consisting of 3 or 4 injection holes.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicants' option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A liquid fuel combustion burner attached to a top end portion of a tube projected into the interior of a combustion apparatus proper, the tube having an interior, and the liquid fuel combustion burner having a structure in which a liquid fuel supplied through a fuel passage formed in the interior of the tube is sprayed into the interior of the combustion apparatus proper together with an atomization-promoting fluid supplied through an atomization-promoting fluid passage formed in the interior of the tube and mixed with the fuel, said burner comprising a burner proper having, formed therein:

a liquid fuel supply passage, the liquid fuel supply passage having a downstream end;

an atomization-promoting fluid supply passage, the atomization-promoting fluid supply passage having a downstream end;

a plurality of injection holes, each of the plurality of injection holes having a central axis and side portions disposed about the central axis;

a first connecting passage connecting the downstream end of the atomization-promoting fluid passage to the injection holes;

a second connecting passage connecting the downstream end of the liquid fuel supply passage to the side portions of the injection holes;

the injection holes being arranged in a state divided into a plurality of groups, each group including a plurality of the injection holes, and the respective injection holes are opened in such directions that in each group of the injection holes, the central axes of the injection holes within each group of injection holes extend to cross one another at a first predetermined angle;

each group of the plurality of groups of the injection holes being arranged at a plurality of positions on the burner proper; and each of the groups of the plurality of groups of the injection holes being separated from another of the groups by a second predetermined angle in the circumferential direction of the burner proper with the central axis of the burner proper being as the center.

2. A liquid fuel combination burner as set forth in claim 1, wherein said first predetermined angle is 10° to 120°, preferably 20° to 90°.

3. A liquid fuel combustion burner as set forth in claim 2, wherein:

the burner proper has a central longitudinal axis; and the respective injection holes are arranged to extend in such directions that in each group of the injection holes, the central longitudinal axis of the burner proper forms a third predetermined angle with the crossing point of the streams from the injection holes.

4. A liquid fuel combustion burner as set forth in claim 3, wherein said third predetermined angle is 20° to 40°.

5. A liquid fuel combustion burner as set forth in claim 1 wherein the second connecting passage connecting the downstream end of the liquid fuel supply passage to the side portions of the respective injection holes is connected substantially in a tangential direction of each injection hole.

6. A liquid fuel combustion burner as set forth in claim 1, wherein the burner proper comprises:

a fuel supply member, the fuel supply member having a top end portion, and a burner tip connected to the top end portion of the fuel supply member.

7. A liquid fuel combustion burner attached to a top end portion of a tube projected into the interior of a combustion apparatus proper, the tube having an interior, and the liquid fuel combustion burner having a structure in which a liquid fuel supplied through a fuel passage formed in the interior of the tube is sprayed into the interior of the combustion apparatus proper together with an atomization-promoting fluid supplied through an atomization-promoting fluid passage formed in the interior of the tube and mixed with the fuel, said burner comprising a burner proper having, formed therein:

a liquid fuel supply passage, the liquid fuel supply passage having a downstream end;

an atomization-promoting fluid supply passage, the atomization-promoting fluid supply passage having a downstream end;

a plurality of injection holes, each of the plurality of injection holes having a central axis and side portions disposed about the central axis;

a first connecting passage connecting the downstream end of the atomization-promoting fluid passage to the injection holes;

a second connecting passage connecting the downstream end of the liquid fuel supply passage to the side portions of the injection holes;

the injection holes being arranged in a state divided into a plurality of groups, each group including a plurality of the injection holes, and the respective injection holes are opened in such directions that in each group of the injection holes, the central axes of the injection holes within each group of injection holes extend to cross one another at a first predetermined angle;

the burner proper having a rear end face, the rear end face having a central part and a peripheral part; and the atomization-promoting fluid supply passage comprises a circular recess at the central part of the rear end face of the burner proper.

8. A liquid fuel combustion burner attached to a top end portion of a tube projected into the interior of a combustion apparatus proper, the tube having an interior, and the liquid fuel combustion burner having a structure in which a liquid fuel supplied through a fuel passage formed in the interior of the tube is sprayed into the interior of the combustion apparatus proper together with an atomization-promoting fluid supplied through an atomization-promoting fluid passage formed in the interior of the tube and mixed with the fuel, said burner comprising a burner proper having, formed therein;

a liquid fuel supply passage, the liquid fuel supply passage having a downstream end;

an atomization-promoting fluid supply passage, the atomization-promoting fluid supply passage having a downstream end;

a plurality of injection holes, each of the plurality of injection holes having a central axis and side portions disposed about the central axis;

a first connecting passage connecting the downstream end of the atomization-promoting fluid passage to the injection holes;

a second connecting passage connecting the downstream end of the liquid fuel supply passage to the side portions of the injection holes;

the injection holes being arranged in a state divided into a plurality of groups, each group including a plurality of the injection holes, and the respective injection holes are opened in such directions that in each group of the injection holes, the central axes of the injection holes within each group of injection holes extend to cross one another at a first predetermined angle;

the burner proper having a rear end face, the rear end face having a central part and a peripheral part; and the liquid fuel supply passage comprises an annular groove at the peripheral part of the rear end face of the burner proper.

9. A fluid fuel spray nozzle for use in a boiler, a heating furnace or the like, said fluid fuel spray nozzle comprising:

at least one first supply passage for providing fluid fuel;

at least one second supply passage for providing a fluid for dividing said fluid fuel into reduced size particles;

at least one injection passage aligned with and connected to said at least one second supply passage;

at least one connecting passage connecting said at least one injection passage to said at least one first supply passage, said at least one connecting passage being substantially tangentially connected to said at least one injection passage;

at least one of:

said at least one connecting passage, and said at least one injection passage comprising means for producing swirling of the fluid fuel upon the fluid fuel being introduced into said at least one injection passage through said at least one connecting passage from said at least one first supply passage;

said division-promoting fluid and said swirling fluid fuel being mixed in said injection passage to form a mixed fluid;

means for providing at least two streams of said mixed fluid, said means for providing at least two streams of said mixed fluid being configured so that one of said two streams of said mixed fluid impinges the other of said at least two streams of said mixed fluid at a first predetermined angle upon said at least two streams of said mixed fluid being sprayed out of said nozzle;

said at least one injection passage comprising a plurality of injection passages;

said plurality of injection passages comprising a plurality of groups of said plurality of injection passages;

each of said plurality of groups of injection passages comprising at least two injection passages; and each of said plurality of groups of injection passages being spaced apart in a circumferential direction from another of said plurality of groups of injection passages at a second predetermined angle.

10. The fluid fuel spray nozzle according to claim 9, wherein said means for providing at least two streams of said mixed fluid comprises said at least two injection passages of each of said plurality of groups of injection passages;

each of said at least two injection passages of each of said plurality of groups of injection passages comprising a longitudinal axis; and said at least two injection passages of each of said plurality of groups of injection passages being formed so that said longitudinal axis of any of said at least two injection passages of a group of injection passages intersects said longitudinal axis of the other of said at least two injection passages of a group of injection passages at said first predetermined angle.

11. The fluid fuel spray nozzle according to claim 10, wherein said first predetermined angle is an angle between about 10° to about 120°.

* * * * *

UNITED STATES PATENT AND TRADEMARK OFFICE

CERTIFICATE OF CORRECTION

PATENT NO. : 5,176,324

DATED : January 5, 1993

INVENTOR(S) : Yutaka FURUSE, Naohiti YOSHII and Tuneo MIYAKE

It is certified that error appears in the above-indentified patent and that said Letters Patent is hereby corrected as shown below:

In column 3, line 29, after 'injection', delete "hoes," and insert --holes,--.

In column 3, line 31, after 'to', delete "20°" and insert --40°--.

In column 3, line 32, after 'injection', delete "hoes" and insert --holes--.

In column 4, line 60, after the first occurrence of 'the', delete "field" and insert --fluid--.

In column 5, line 56, after 'cap', delete "25 by" and insert --35. By--.

In column 7, line 18, after the second occurrence of 'stream', delete "g" and insert --4--.

UNITED STATES PATENT AND TRADEMARK OFFICE

CERTIFICATE OF CORRECTION

PATENT NO. :5,176,324

DATED :January 5, 1993

INVENTOR(S) :Yutaka FURUSE, Naohiti YOSHII and Tuneo MIYAKE

It is certified that error appears in the above-indentified patent and that said Letters Patent is hereby corrected as shown below:

In column 9, line 15, after 'recess', delete "20°" and insert --20,--.

In column 9, line 46, after 'angle', delete "g" and insert --α--.

In column 9, line 56, after 'hole', delete "30°" and insert --30,--.

Signed and Sealed this

Ninth Day of August, 1994

*Attest:*

*Attesting Officer*

Bruce Lehman

BRUCE LEHMAN

*Commissioner of Patents and Trademarks*